United States Patent [19]

Takayasu

[11] Patent Number: 4,518,540

[45] Date of Patent: May 21, 1985

[54] MULTI-FUEL CARBURETOR

[75] Inventor: Hidekazu Takayasu, Hamamatsu, Japan

[73] Assignees: Yamaha Hatsudoki Kabushika Kaisha; Sanshin Kogyo Kabushiki Kaisha, both of Japan

[21] Appl. No.: 460,765

[22] Filed: Jan. 25, 1983

[30] Foreign Application Priority Data

Jan. 26, 1982 [JP] Japan ..... 57-9583

[51] Int. Cl.[3] ..... F02M 13/06

[52] U.S. Cl. ..... 261/18 B; 123/577; 261/34 A; 261/34 R; 261/23 A

[58] Field of Search ..... 261/23 A, 18 B, 34 A, 261/34 R; 123/577

[56] References Cited

U.S. PATENT DOCUMENTS

| | | | |
|---|---|---|---|
| 1,155,232 | 9/1915 | Hagar | 261/18 B |
| 1,376,343 | 4/1921 | Lamb | 261/18 B |
| 1,576,295 | 3/1926 | Ball | 261/18 B |
| 2,317,625 | 4/1943 | Mallory | 261/23 A |
| 2,875,990 | 3/1959 | Gretz | 261/23 A |
| 2,892,622 | 6/1959 | Goodyear | 261/34 R |
| 2,973,947 | 3/1961 | Sterner | 261/23 A |
| 3,104,272 | 9/1963 | Carlson et al. | 261/23 A |
| 4,003,968 | 1/1977 | Rickert | 261/34 R |
| 4,277,423 | 7/1981 | Noguez | 261/34 R |
| 4,426,962 | 1/1984 | Otani et al. | 261/142 |

FOREIGN PATENT DOCUMENTS

| | | | |
|---|---|---|---|
| Ad.38149 | 4/1931 | France | 261/18 B |
| 109367 | 6/1925 | Switzerland | 261/18 B |
| 164474 | 6/1921 | United Kingdom | 261/18 B |

OTHER PUBLICATIONS

"Kerosene 25", Yamaha, 4 pgs., Yamaha Motor Co.

*Primary Examiner*—Tim Miles
*Attorney, Agent, or Firm*—Ernest A. Beutler

[57] ABSTRACT

An improved two-barrel, multi-fuel carburetor. The carburetor comprises a main body portion in which the main fuel bowl is positioned and an auxiliary body portion in which an auxiliary fuel bowl is positioned. All of the fuel and air passages extending between the main and auxiliary body portions extend through faces of the respective body portions that are in facing engagement when the auxiliary body portion is affixed to the main body portion so as to eliminate the necessity for external plumbing. Also, an improved arrangement is provided for preventing the discharge of fuel from the auxiliary fuel discharge under some engine running conditions. The carburetor also employs a simplified accelerating pump discharge that uses only a single accelerating pump discharge tube that extends completely through one of the induction passages and which terminates in the other induction passage and has discharge ports in both induction passages.

16 Claims, 7 Drawing Figures

MULTI-FUEL CARBURETOR

BACKGROUND OF THE INVENTION

This invention relates to a multi-fuel carburetor and more particularly to an improved construction for such a carburetor.

The use of multi-fuel engines is well known. Normally, the engine is operated on one fuel during a certain running condition and on another fuel during other running conditions. For example, it is known to operate outboard motors or other marine engines with kerosene or alcohol as the main fuel. However, a higher quality fuel such as gasoline is employed for such running conditions as starting, idle or during acceleration. Conventionally, the fuels are supplied by a multi-fuel carburetor that has a main fuel bowl in which the kerosene or alcohol is contained and an auxiliary fuel bowl in which the gasoline is contained. The different fuels are supplied to the same induction passages by different, or at times, common fuel discharge circuits. With multi-fuel carburetors of the type heretofore known, it has been the common practice to employ external plumbing or piping so as to supply the various fuel circuits, particularly from the auxiliary fuel bowl. Such arrangements obviously result in complicated carburetor constructions and the likelihood of damage or difficulties during servicing.

It is, therefore, a principle object of this invention to provide an improved, simplified multi-fuel carburetor.

It is a further object of this invention to provide a multi-fuel carburetor in which the external plumbing is reduced.

When multiple fuels are employed, it is desirable to insure against the discharge of the auxiliary fuel under running conditions when it is not required. For example, it is desirable to cut off the flow of gasoline when the engine is operating at a steady state, off idle condition. Although various devices have been proposed for this purpose, they are not always satisfactory, particularly when a single fuel bowl serves multiple induction passages.

It is, therefore, a further object of this invention to provide an improved auxiliary fuel cut off system for a multi-fuel carburetor.

It is another object of the invention to provide an improved fuel cut off system for a multi-barrel, multi-fuel carburetor.

In some forms of multiple barrel carburetors, each carburetor barrel serves different engine chambers or groups of chambers. When this is done, each carburetor barrel must be provided with a complete set of discharge circuits to accommodate all running conditions. When this is done, the construction of the carburetor obviously becomes very complicated.

It is, therefore, a still further object of this invention to provide a simplified construction for a multiple barrel carburetor.

SUMMARY OF THE INVENTION

A first feature of this invention is adapted to be embodied in a multiple fuel carburetor having a main body portion defining an induction passage, a main fuel bowl, main fuel circuit discharge means for delivering fuel from the main fuel bowl to the induction passage, a supplemental passage communicating with the induction passage and extending through the main body portion and an auxiliary body carrying auxiliary fuel bowl means for supplying an auxiliary fuel to the induction passage. In accordance with this feature of the invention, the supplemental passage of the main body terminates in a face of the main body that is engaged by the auxiliary body for communication of the supplemental passage with a corresponding passage in the auxiliary body.

Another feature of this invention is also adapted to be embodied in a multi-fuel carburetor. Such a carburetor has a pair of induction passages each adapted to serve a different chamber. A main fuel bowl serves main fuel discharge means for deliverying fuel from the main fuel bowl to each of the induction passages. An auxiliary fuel bowl is also provided and auxiliary fuel discharge means in each of the induction passages is served by the auxiliary fuel bowl. In accordance with this feature of the invention, means are provided for precluding the discharge of auxiliary fuel from the auxiliary fuel discharge means. This means comprises a sensing port in each of the induction passages at a point that is spaced from the discharge of the auxiliary fuel discharge means. Means including check valve means communicate the lowest pressure sensed by the respective sensing ports to the area above the fuel in the auxiliary fuel bowl.

Another feature of the invention is adapted to be embodied in a two-barrel carburetor comprising a main body portion that defines a pair of parallel induction passages. A passage extends transversely through one side of the main body portion into one of the induction passages and extends through the area of the main body portion between the induction passages. A tube extends through the passage and has discharge ports opening into each of the induction passages.

DETAILED DESCRIPTION OF THE PREFERRED EMBODIMENT OF THE INVENTION

Figure 1:
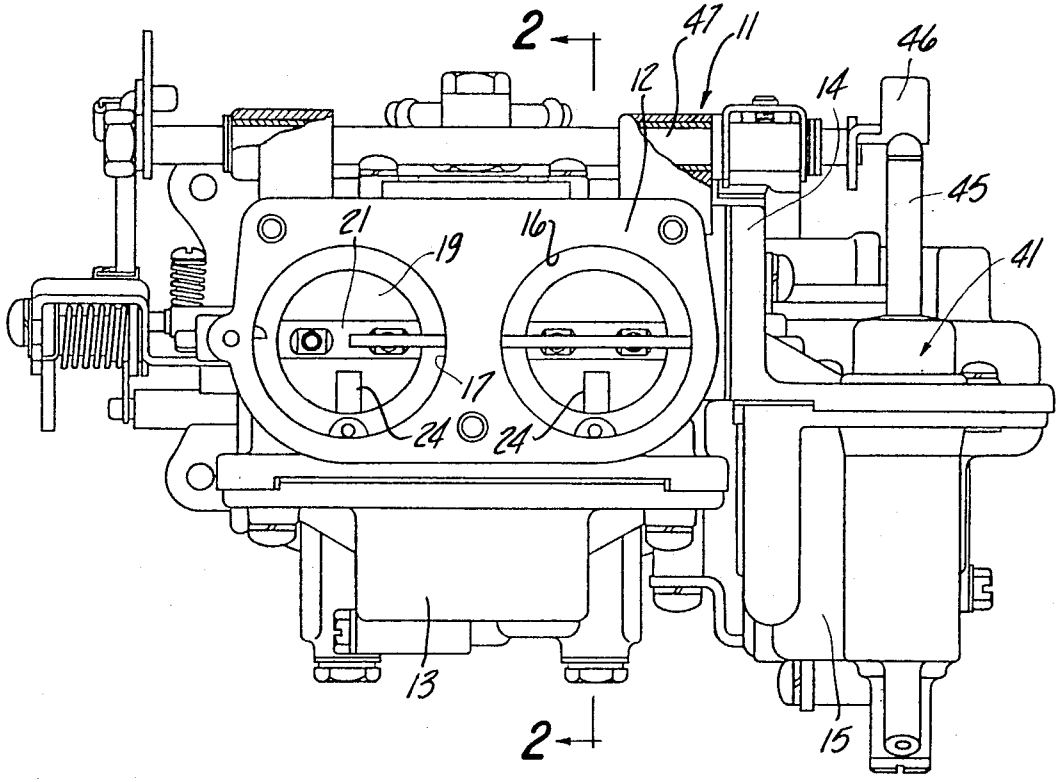
FIG. 1 is an end elevational view of a two-barrel, multi-fuel carburetor constructed in accordance with the invention.
Figure 2:
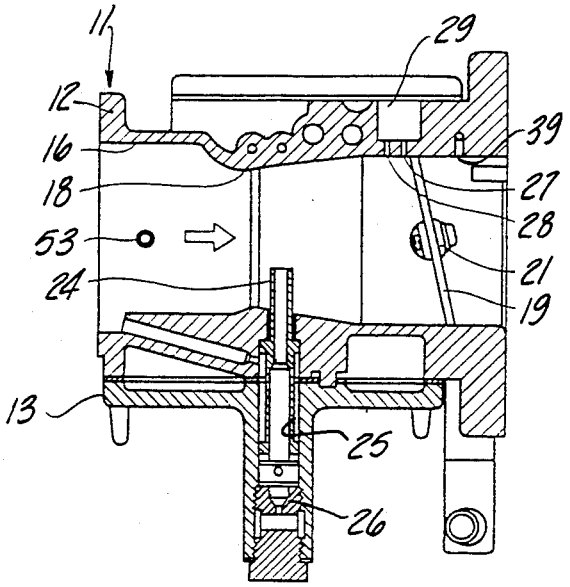
FIG. 2 is a cross-sectional view taken along the line 2—2 of FIG. 1 and shows the main fuel discharge circuit.
Figure 3:
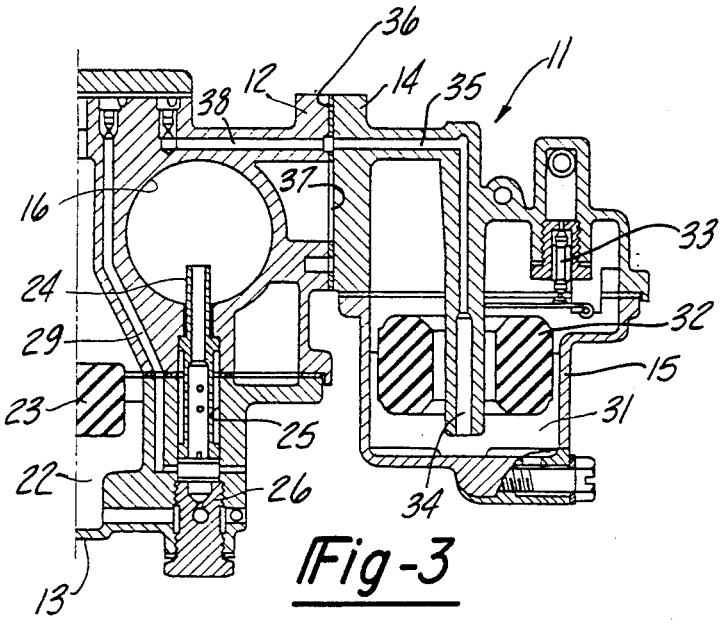
FIG. 3 is a cross-sectional view taken generally at a right angle to FIG. 2 and through the discharge nozzle of the carburetor.

In the drawings, the reference numeral 11 indicates generally a two-barrel, multi-fuel carburetor constructed in accordance with the invention. The carburetor 11 includes a main body portion 12 to which a main fuel bowl 13 is affixed in a known manner. An auxiliary body portion 14 is affixed to one side of the main body portion 12, in a manner to be described, and has affixed to it an auxiliary fuel bowl 15.

The main body portion 12 defines a pair of parallel induction passages 16 and 17. Each induction passage 16 and 17 is formed with a respective venturi section 18. A throttle valve 19 is positioned in each induction passage 16, 17 downstream of the venturi section 18. The throttle valves 19 are affixed to a common throttle valve shaft 21 that is rotatably supported in the main body portion 12 for rotatably positioning the throttle valves 19 in a known manner.

The fuel bowl 13 defines a float chamber 22 in which a float 23 is positioned. The float 23 operates a needle valve (not shown) in a known manner so as to maintain a uniform head of fuel in the bowl 23. The fuel is supplied to the bowl 23 in a known manner through the needle valve. The fuel supplied to the bowl 22 is the main running fuel and may constitute kerosene, alcohol or the like.

Main fuel discharge nozzles 24 extend into each of the induction passages 16, 17, adjacent the venturi section 18. The main fuel discharge nozzles 24 each depend into a respective main fuel well 25 formed in the float bowl 13. Fuel is delivered to the main fuel wells 25 from the float chamber 22 through respective main metering jets 26.

The main fuel well 25 also serves a pair of transition ports 27 and 28 that intersect the induction passages 16, 17, adjacent the idle position of the throttle valves 19 but upstream of it. The transition ports 27 and 28 are swept by the throttle valves 19 and become located on the downstream side of the throttle valve 19 as it moves to an off idle position. Fuel is supplied to the transition ports 27 and 28 by means of an off idle fuel discharge circuit 29 that extends through the fuel bowl 13 and main body portion 12.

The auxiliary fuel bowl 15 defines an auxiliary float chamber 31 in which a float 32 is positioned. The float 32 cooperates with a needle valve 33 so as to control the admission of an auxiliary fuel, such as gasoline, from a suitable source into the float chamber 31 and to provide a uniform head of fuel in the auxiliary float chamber 31.

A pair of idle fuel nozzles 34 are carried by the auxiliary body portion 14 and depend into the auxiliary float chamber 31. The nozzles 34 serve idle fuel passages 35 that extend through the auxiliary body 14 and which terminate in a face 36 of the body 14 which face is abuttingly engaged with a corresponding face 37 of the main body portion 12. A pair of idle passages 38 extend from the face 37 in registry with the port at the end of the passage 35 through the body 12. The idle passages 38 of the main body portion 12 terminate in idle discharge ports 39 formed in the respective induction passages 16, 17, downstream of the throttle valves 19.

Figure 4:
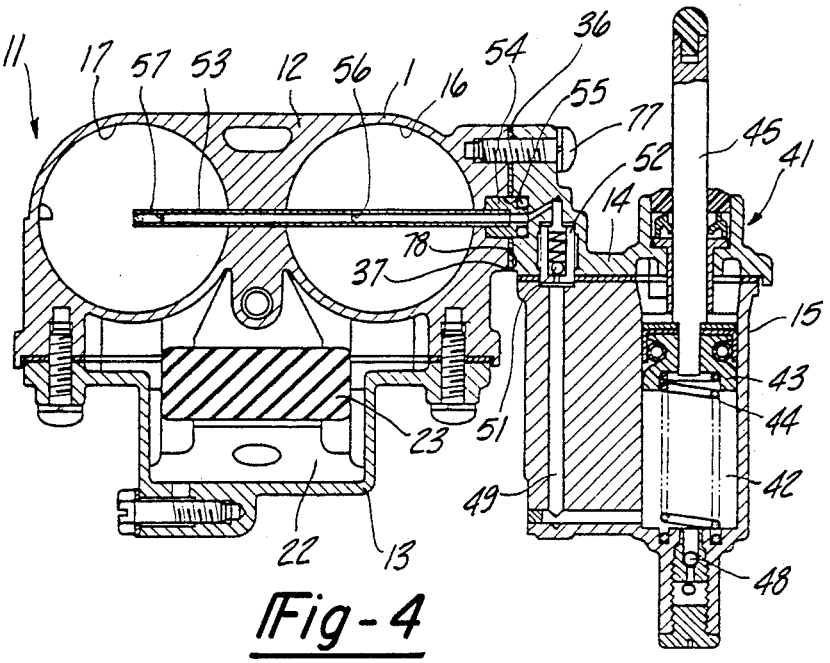
FIG. 4 is a cross-sectional view through the induction passages and shows the accelerating pump circuit.
Figure 5:
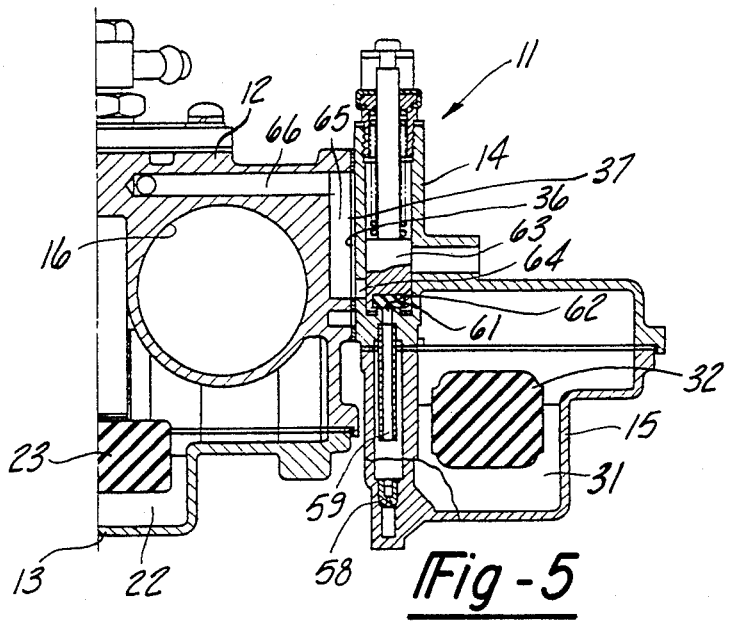
FIG. 5 is a cross-sectional view through the induction passages and shows the starting circuit.
Figure 6:
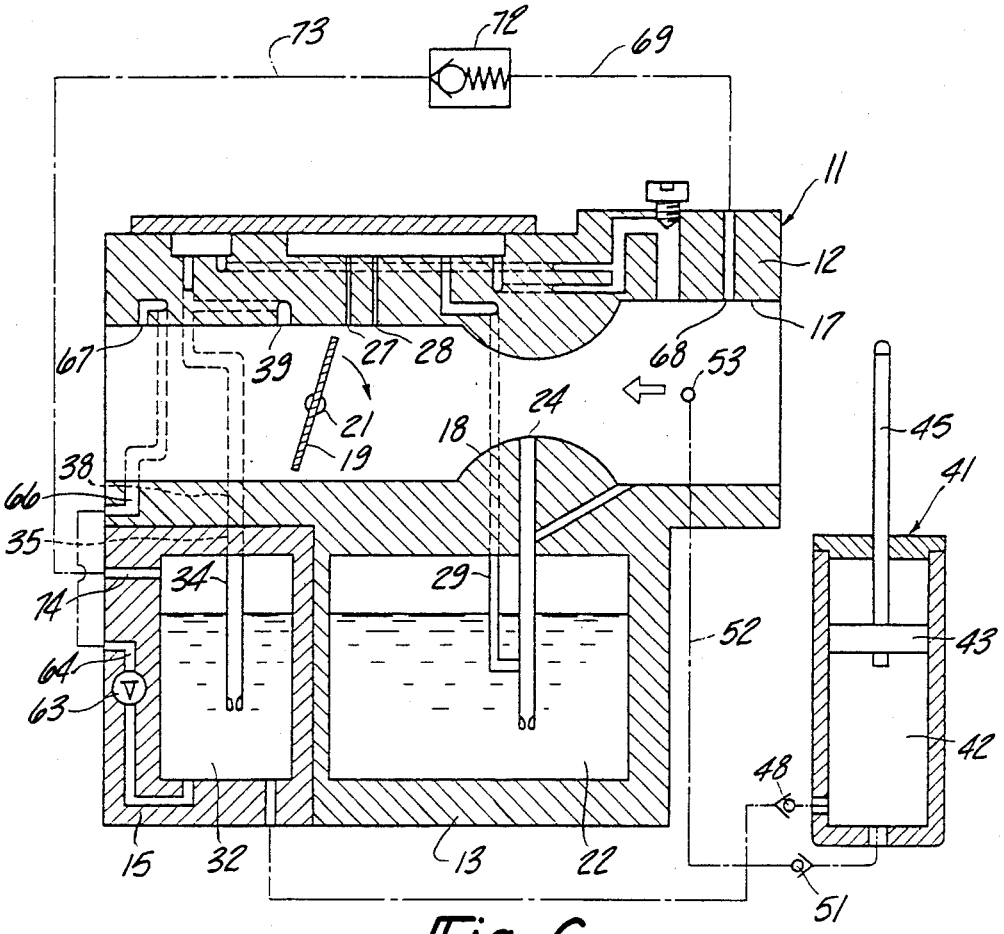
FIG. 6 is a schematic view showing the discharge circuits of the carburetor.

The auxiliary body 14 also carries an accelerating pump assembly, indicated generally by the reference numeral 41 and shown in most detail in FIGS. 4 and 6. The accelerating pump assembly 41 is adapted to discharge an amount of gasoline into the intake passages 16, 17 upon sudden opening of the throttle valves 19. The accelerating pump assembly 41 includes a bore 42 formed in the auxiliary fuel bowl 15 in which a piston 43 is supported for reciprocation. A coil compression spring 44 acts on the underside of the piston 41 so as to urge it and a piston rod 45 connected to it upwardly into engagement with a lever 46 that is affixed to a shaft 47 that is operated by means of a suitable linkage system with the throttle valves 19.

Fuel is delivered to the bore 42 from the auxiliary float chamber 31 through a suitable passage and check valve assembly 48. Fuel is discharged from the bore 42 through an accelerating pump discharge passage 49 formed in the auxiliary fuel bowl 31. The passage 49 extends upwardly through the auxiliary fuel bowl 15 and terminates at a discharge check valve 51 that is carried by the auxiliary body portion 14. The auxiliary body portion 14 has an accelerating pump discharge passage 52 that extends from the check valve 51 and which terminates in a counterbore that is formed in the body portion surface 36.

A counterbored passage is drilled through the main body portion 12 from the surface 37 and across the induction passage 16 and through the portion of the body portion 12 positioned between the induction passages 16 and 17. An accelerating pump discharge tube 53 extends through this passage and terminates at approximatey the center of the intake passage 17. The accelerating pump discharge tube 53 has an enlarged portion 54 formed at its base that is supported in an opening 55 in the main body portion 12 at the surface 37. An O-ring seal engages the portion 54 and the auxiliary body portion counterbore so as to provide a seal with the auxiliary body 14. The center portion of the part of the accelerating pump tube 53 that passes through the induction passage 16 is formed with a discharge port 56 that is directed in a downstream direction in the passage 16. In a like manner, the outer end of the accelerating pump tube 53 that extends into the intake passage 17 is formed with a downstream directed discharge port 57.

The auxiliary float chamber 31 also serves a cold starting enrichment circuit. This circuit includes a metering jet 58 that is carried by the auxiliary fuel bowl 15 and which communicates with the fuel in the auxiliary float chamber 31. The jet 58 is at the base of a well in which a starting nozzle 59 depends. The upper end of the starting nozzle 59 terminates at a passage 61 that is adapted to be opened and closed by a seal 62 carried by a cold starting enrichment valve member 63 that is supported for reciprocation in the auxiliary body 14. The valve 63 controls the communication of the passage 61 with a passage 64 that extends transversely through the auxiliary body portion 14 and which terminates in its face 36.

The cold starting passage 64 has sufficient transverse width so as to mate with a pair of main body cold starting passages 65 which, in turn, terminate in passages 66. The passages 66 each terminate in discharge ports 67 formed in the respective induction passages 16, 17, downstream of the throttle valves 19 and the idle discharge ports 39.

An arrangement is provided for insuring against the discharge of gasoline from the auxiliary fuel bowl 15 when the engine is operating in a mid range condition. This system includes a pair of sensing ports 68 (FIG. 6) that extend into each of the induction passages 16, 17, well upstream of the venturi section 18. Passages 69 extend from each of the sensing ports 68 and terminate in a recessed passage 71 formed in the main body portion face 37. The passage 71 communicates with a check valve 72 which, in turn, communicates with a passage 73 formed in the auxiliary body portion 14 and which terminates at a port 74 that extends into the area above the fuel in the auxiliary float chamber 31.

Figure 7:
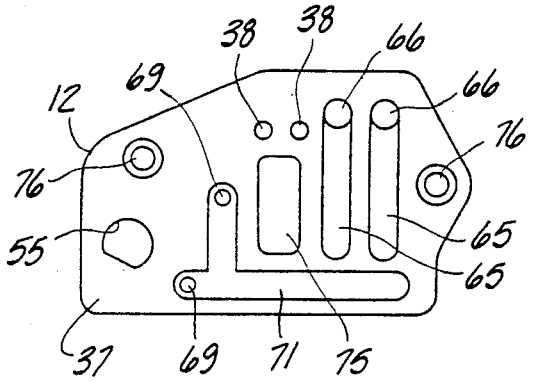
FIG. 7 is a plan view showing the face of the main body portion of the carburetor with which the auxiliary body mates.

As may be seen from FIG. 7, a cavity 75 is formed centrally in the main body portion surface 37. In addition, a pair of tapped holes 76 are formed at opposite sides of the surface 37 so as to receive screws 77 for affixing the auxiliary body portion 14 to the main body portion 12. A gasket 78 is interposed between the surfaces 36 and 37 and is formed with suitable passages so as to facilitate the communication of the various discharge circuits and air circuits, as aforedescribed.

OPERATION

For starting, particularly when the associated engine is cold, the cold starting valve 63 is opened by drawing it upwardly so that the seal 62 will open the port 61. Starting fuel may then be drawn from the auxiliary float chamber 31 past the jet 58, through the nozzle 59 and passage 61 into the main body passages 65. This fuel is then discharged through the passages 66 and port 67 into the induction passages 16, 17, downstream of the throttle valve 19.

Once the engine is started, the cold starting valve 63 is closed. During idle operation, fuel will be drawn from the auxiliary float chamber 31 through the idle nozzles 34 and the idle discharge passages 35 of the auxiliary body portion 14. The idle fuel will then flow into the main body portion idle discharge passages 38 for discharge through the idle ports 39.

As the throttle valves 19 are progressively opened, the transition ports 27 and 28 will be sequentially opened. When the transition ports 27 and/or 28 are positioned on the downstream side of the throttle valve 19, fuel will be discharged from these ports, the fuel being drawn from the main float chamber 22. This fuel will pass through the passages 29 into the transition ports 27, 28. During this operation, and assuming that the engine is still operating at a fairly slow speed, gasoline will still be delivered through the idle port 39.

Upon continued opening of the throttle valves 19, they will eventually reach a point where the main fuel discharge nozzles 24 will begin to discharge. At this time, fuel is drawn from the main fuel float chamber 22 through the metering jets 25 and is discharged from the main discharge nozzles 24.

Since the induction passages 16, 17, serve different chambers, there will be pulsations in the respective intake pressure exerted at the ports 68. Eventually, there will be sufficient negative pressure generated through the check valve 71 so that the pressure transmitted through the port 74 above the fuel in the auxiliary float chamber 32 will be the same as the pressure at the idle discharge ports 39. When this condition occurs, the discharge of idle fuel from the auxiliary fuel bowl 15 will be stopped. This insures against unnecessary depletion of the auxiliary fuel.

Upon said opening of the throttle valves 19, the shaft 47 and lever 46 will urge the accelerating pump rod 45 downwardly. This causes downward movement of the piston 43 which expels fuel from the bore 47 past the discharge check valve 51 into the accelerating pump nozzle 53. This fuel will be discharge through the discharge ports 56 and 57 into the induction passages 16, 17, respectively. Thus, under acceleration, gasoline and kerosene will be delivered to the engine and good acceleration and smooth engine operation will result.

When the throttle valves are closed again, the piston 43 will be urged upwardly by the spring 44. The bore 42 will then be charged with additional gasoline from the auxiliary float chamber 32 through the check valve 48.

It should be readily apparent that in the described construction all of the air and fuel passages between the auxiliary body 14 and the main body 12 extend through the respective faces 36, 37 of these bodies. This greatly simplifies the construction of the carburetor and eliminates the necessity for external passages and plumbing. Furthermore, if only a single fuel operation is required, the auxiliary body 14 and auxiliary fuel bowl 15 may be removed and the main body surface 37 closed by a suitable closure plate. In addition to simplifying the plumbing by having all of the fuel and air passages extend through the mating faces of the auxiliary and main bodies 14, 12, the accelerating pump discharge nozzle arrangement further simplifies the construction. Furthermore, an improved and simplified arrangement has been incorporated so as to insure against the uneconomical discharge of gasoline when the engine is operating at higher speed ranges and the use of this fuel is unnecessary.

Although an embodiment of the invention has been described, it is believed to be obvious that various changes and modifications may be made without departing from the spirit and scope of the invention, as defined by the appended claims.

I claim:

1. In a multi-fuel carburetor having a main body portion defining an induction passage, a main fuel bowl, main fuel discharge circuit means for delivering fuel from said main fuel bowl to said induction passage, a supplementary passage communicating with said induction passage and extending through said main body portion, and an auxiliary body carrying auxiliary fuel bowl means for supplying an auxiliary fuel to said induction passage, the improvement comprising said supplementary passage of said main body terminating in a face of said main body engaged by said auxiliary body for cooperation of said supplementary passage with a corresponding passage in said auxiliary body and for delivering fuel to said induction passage from said auxiliary fuel bowl means, and cold starting valve means interposed in said auxiliary body for controlling the flow of fuel from said auxiliary fuel bowl means to said supplementary passage.

2. In a multi-fuel carburetor as set forth in claim 1 wherein the supplementary passages comprises an idle discharge port positioned in the induction passage.

3. In a multi-fuel carburetor having a main body portion defining an induction passage, a main fuel bowl, main fuel discharge circuit means for delivering fuel from said main fuel bowl to said induction passage, a supplementary passage communicating with said induction passage and extending through said main body portion, and an auxiliary body carrying auxiliary fuel bowl means for supplying an auxiliary fuel to said induction passage, the improvement comprising said supplementary passage of said main body terminating in a face of said main body engaged by said auxiliary body for cooperation of said supplementary passage with a corresponding passage in said auxiliary body and for delivering fuel to said induction passage from said auxiliary fuel bowl means, and accelerating pump means carried by said auxiliary body and adapted to deliver fuel from said auxiliary fuel bowl means to said supplementary passage.

4. In a multi-fuel carburetor as set forth in claim 3 wherein there are a pair of induction passages and the accelerating pump includes an accelerating pump discharge tube extending completely through one of said induction passages and terminating in the other of said induction passages, said accelerating pump tube having accelerating pump discharge ports formed in each of said induction passages.

5. In a multi-fuel carburetor having a main body portion defining an induction passage, a main fuel bowl, main fuel discharge circuit means for delivering fuel from said main fuel bowl to said induction passage, a supplementary passage communicating with said induction passage and extending through said main body portion, and an auxiliary body carrying auxiliary fuel bowl means for supplying an auxiliary fuel to said induction passage, the improvement comprising said supplementary passage of said main body terminating in a face of said main body engaged by said auxiliary body for cooperation of said supplementary passage with a corresponding passage in said auxiliary body and for delivering fuel to said induction passage from said auxiliary fuel bowl means, said supplementary passage comprising an idle discharge port in the main induction passage, and cold starting enrichment means for delivering fuel from said auxiliary fuel bowl means to said induction passage including a cold starting discharge passage extending through the main body portion from said induction passage and terminating in said main body portion face and adapted to communicate with a corresponding passage in said auxiliary body, accelerating pump discharge means extending through said main body portion from an accelerating pump discharge in said induction passage and terminating at an opening in said main body portion face, and accelerating pump means carried by said auxiliary body for delivering fuel from said auxiliary fuel bowl means to said accelerating pump discharge passage.

6. In a multi-fuel carburetor as set forth in claim 5 wherein there are a pair of induction passages and the accelerating pump discharge means comprises an accelerating pump discharge tube extending through one of the induction passages and terminating in the other of the induction passages and having accelerating pump discharge ports formed in each of said induction passages.

7. In a multi-fuel carburetor as set forth in claim 6 wherein there are a pair of induction passages and the accelerating pump discharge means comprises an accelerating pump discharge tube extending through one of the induction passages and terminating in the other of the induction passages and having accelerating pump discharge ports formed in each of said induction passages.

8. In a multi-fuel carburetor having a main body portion defining an induction passage, a main fuel bowl, main fuel discharge circuit means for delivering fuel from said main fuel bowl to said induction passage, a supplementary air passage communicating with said induction passage and extending through said main body portion, and an auxiliary body carrying auxiliary fuel bowl means for supplying an auxiliary fuel to said induction passage, the improvement comprising said supplementary air passage of said main body terminating in a face of said main body engaged by said auxiliary body for cooperation of said supplementary air passage with a corresponding passage in said auxiliary body, idle fuel discharge means in said main body portion and terminating at an idle discharge port, said idle discharge passage means including a passage terminating in said main body portion face and communicating with a corresponding passage in said auxiliary body for delivering fuel from said auxiliary fuel bowl means to said induction passage, the supplementary air passage being effective to communicate air pressure from the induction passage to a point above the fuel in said auxiliary fuel bowl means for terminating the discharge of idle fuel when the pressure at said supplementary air passage is lower than the pressure at said idle discharge port.

9. In a multi-fuel carburetor as set forth in claim 8 wherein there are a pair of induction passages and a single auxiliary fuel bowl and further including check valve means between the supplementary passages in the main body portion and the area above the fuel in said auxiliary fuel bowl so that only the lower of the two pressures is exerted thereupon.

10. In a multi-fuel carburetor as set forth in claim 9 further including cold starting enrichment means for delivering fuel from the auxiliary fuel bowl to the induction passage including a cold starting discharge passage extending through the main body portion from said induction passage and terminating in the main body portion face and adapted to communicate with a corresponding passage in the auxiliary body, and accelerating pump discharge means extending through said main body portion from an accelerating pump discharge in said induction passage and terminating at an opening in said main body portion face, and accelerating pump means carried by said auxiliary body portion for delivering fuel from said auxiliary fuel bowl means to said accelerating pump discharge passage.

11. In a multi-fuel carburetor having a pair of induction passages each adapted to serve a different chamber of an associated engine, a main fuel bowl, main fuel discharge means for delivering fuel from said main fuel bowl to each of said induction passages, an auxiliary fuel bowl and an auxiliary fuel discharge means in each of said induction passages served by said auxiliary fuel bowl, the improvement comprising means precluding the discharge of auxiliary fuel from said auxiliary fuel discharge means comprising a sensing port in each of said induction passages at a point spaced from the discharge of said auxiliary fuel discharge means, and means including check valve means for communicating the lowest pressure sensed by the respective of said sensing ports to the area above the fuel in said auxiliary fuel bowl.

12. In a multi-fuel carburetor as set forth in claim 11 wherein the induction passages are formed by a main body portion and the auxiliary fuel bowl is formed by an auxiliary body portion affixed to said main body portion, said communicating means comprising passages extending through the mating faces of said body portions.

13. In a multi-fuel carburetor as set forth in claim 12 wherein the auxiliary fuel discharge means comprises idle discharge means.

14. A two-barrel carburetor for supplying a charge to a pair of cylinders comprising a main body portion defining a pair of parallel induction passages each adapted to serve a separate cylinder, throttle valve means for controlling the flow through said induction passages, a venturi section in each of said induction passages upstream of said throttle valve means, main fuel discharge means for discharging fuel into each of said venturi sections, a passage extending transversely through one side of said main body portion into one of said induction passages and extending through the area of said main body portion between said induction passages and upstream of said throttle valve means and said venturi sections, a tube extending through said passage, said one induction passage and terminating in the other of the induction passages, said tube being formed with a discharge port facing in a downstream direction in each of said induction passages, accelerating pump means for pressurizing fuel in response to movement of said throttle valve means, and means for delivering fuel pressurized by said accelerating pump from said accelerating pump to said tube for discharging from said discharge ports.

15. A two-barrel carburetor as set forth in claim 14 wherein the tube has an enlarged portion at one end thereof that is supported within the main body portion and which registers with an accelerating fuel passage in an auxiliary body affixed to said main body portion.

16. A two-barrel carburetor as set forth in claim 15 wherein the accelerating pump means is carried by the auxiliary body for delivering fuel to the tube.

* * * * *